US006294740B1

(12) United States Patent
Van Swearingen

(10) Patent No.: US 6,294,740 B1
(45) Date of Patent: Sep. 25, 2001

(54) SPRING CLIP FOR A GAS TUBE SURGE ARRESTOR

(75) Inventor: Kendrick Van Swearingen, Addison, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/398,708

(22) Filed: Sep. 20, 1999

(51) Int. Cl.[7] ..... H01B 17/26

(52) U.S. Cl. ..... 174/151; 174/65 R; 174/65 G; 361/119

(58) Field of Search ..... 174/65 R, 65 G, 174/151, 152 G, 152 R; 361/119; 200/282, 290; 337/215

(56) References Cited

U.S. PATENT DOCUMENTS

| | | | | |
|---|---|---|---|---|
| 3,886,411 | | 5/1975 | Klayum . | |
| 4,250,348 | * | 2/1981 | Kitagawa | 174/65 SS |
| 4,323,727 | * | 4/1982 | Berg | 174/135 |
| 4,359,764 | | 11/1982 | Block . | |
| 4,409,637 | | 10/1983 | Block . | |
| 4,463,403 | | 7/1984 | Fasano . | |
| 4,544,984 | | 10/1985 | Kawanami et al. . | |
| 4,554,608 | | 11/1985 | Block . | |
| 4,633,359 | | 12/1986 | Mickelson et al. . | |
| 5,508,873 | | 4/1996 | Knapp et al. . | |
| 5,644,104 | * | 7/1997 | Porter et al. | 174/65 R |
| 5,712,755 | | 1/1998 | Glaser et al. . | |
| 6,140,582 | * | 10/2000 | Sheehan | 174/65 G |
| 6,162,995 | * | 12/2000 | Bachle et al. | 174/151 |
| 6,187,088 | * | 1/2001 | Copeland | 174/65 G |

FOREIGN PATENT DOCUMENTS 660 261 A5 3/1987 (CH) .

* cited by examiner

*Primary Examiner*—Dean A. Reichard
*Assistant Examiner*—Adolfo Nino
(74) *Attorney, Agent, or Firm*—Jenkens & Gilchrist

(57) ABSTRACT

A one-piece spring clip is provided for retaining a gas tube element used in a surge arrestor having a cap with an interior portion. The spring clip includes a generally flat disk having a periphery, a first side and a second side. A plurality of first tabs extend from the first side of the disk at the periphery thereof to retain the gas tube element. A plurality of second tabs extend from the second side of the disk at the periphery thereof to provide a spring force between the interior portion of the cap and the gas tube element.

43 Claims, 5 Drawing Sheets

Fig. 4 (Prior Art)
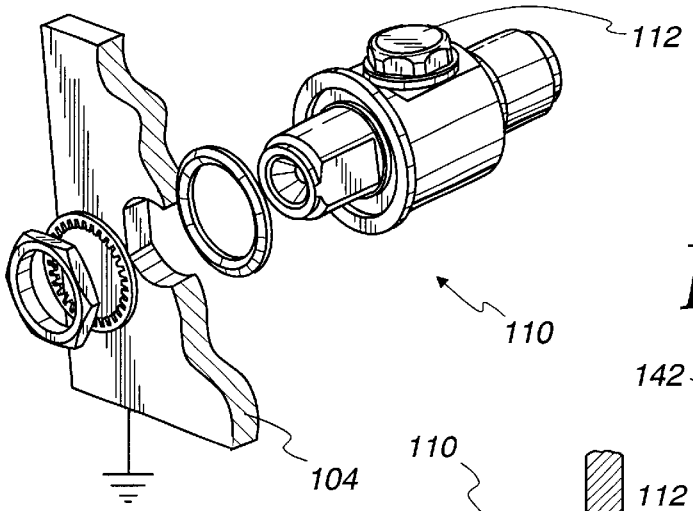
Fig. 5a
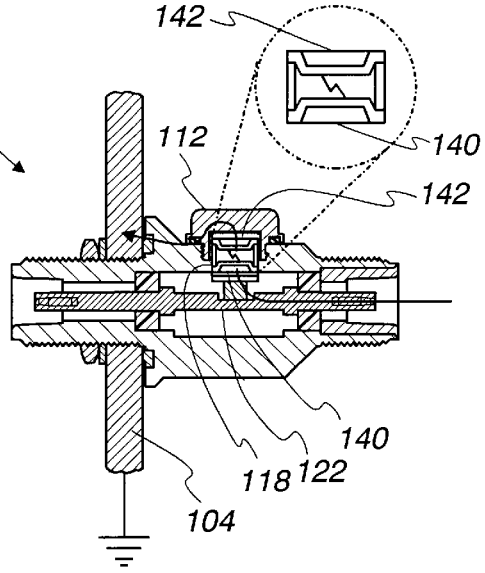
Fig. 5 (Prior Art)
Fig. 6
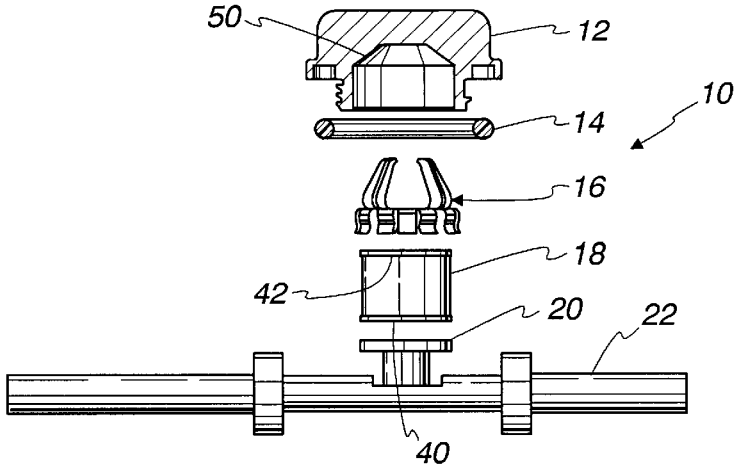

SPRING CLIP FOR A GAS TUBE SURGE ARRESTOR

FILED OF THE INVENTION

The present invention relates to surge suppression devices. More specifically, this invention relates to a one-piece spring clip for a surge arrestor.

BACKGROUND OF THE INVENTION

Gas tube surge arrestors are broadband radio frequency (RF) devices that are capable of allowing a DC-bias to pass along the center conductor of a transmission line while harmlessly shunting the lower frequencies associated with faults or transients to ground. Faults or transients may be induced, for example, by lightning. Many gas tube surge arrestors contain a replaceable gas tube element. Under normal operating conditions, the gas tube element functions as a simple capacitor with a shunt capacitance of typically less than 1 picofarad. However, in the presence of a transient, the gas within the gas tube element ionizes and switches the gas tube element to a low impedance state. The gas tube element may be filled with any suitable inert gas. In this low impedance state, the gas tube element harmlessly passes any surge current present on the center conductor of a transmission line to ground.

Gas tube surge arrestors are known in the art. An example of one type of known gas tube surge arrestor is shown in FIG. 1. There, a surge arrestor 110 includes a surge is arrestor cap 112, an annular seal 114, a bent disk spring 102, a retention clip 100, a gas tube element 118, a center disk 120, and a center conductor 122. The retention clip 100 is best shown in FIGS. 2*a* and 2*b*. The retention clip 100 fits into the surge arrestor cap 112. The retention clip 100 was used to retain the gas tube element 118 in the surge arrestor cap 112. The gas tube element 118 includes opposing first and second electrodes 140, 142. The electrodes 140, 142 include radial rims which project radially beyond the outer diameter of the body of the gas tube element 118. Other known gas tube elements have electrodes that include radial rims which may not project radially beyond the outer diameter of the body of the gas tube element. In any case, the retention clip 100 snaps over and/or beyond the electrodes and applies inward pressure on the gas tube element 118 to secure the gas tube element 118 in the retention clip 100.

The surge arrestor cap 112 unscrews from the surge arrestor 110 to access the gas tube element 118 housed in the surge arrestor cap 112, as shown in FIGS. 1 and 3. To remove the gas tube element 118 from the retention clip 100, axial pressure was applied in a direction away from the cap 112. However, the retention clip 100 had the dual functions of retaining the gas tube element 118 and securing itself in the cap 112. These two different functions forced designers to produce the prior retention clip 100 and cap 112 within very tight tolerances. Consequently, the cost and time required to produce the retention clip 100 was increased. Likewise, the tight tolerances made installation of the retention clip 100 in the cap 112 and installation of the gas tube element 118 in the retention clip 100 more difficult. In addition, a separate piece, the bent disk spring 102, was provided to apply downward pressure between the gas tube element 118 and the center disk 120 to ensure a good electrical connection between the first electrode 140 and the center disk 120 which was connected to the center conductor 122 of a coaxial geometry. The bent disk spring 102 also provided pressure between the gas tube element 118 and the cap 112 to ensure a good electrical connection between the second electrode 142 and the inner surface of the surge arrestor cap 112. However, inclusion of an additional piece, the bent disk spring 102, made installing the retention clip 100 into the cap 112 more expensive.

The opposing inner surfaces of the electrodes 140, 142 within the gas tube element 118 define an arc gap, as shown in FIG. 5. The path that a transient surge follows is also shown in FIG. 5. For example, if an antenna were struck by lightning, that current surge would be conducted through the antenna, through the center conductor 122 of the connected transmission line, through the gas tube element 118 by sparking between the two end electrodes 140, 142 (as shown in FIG. 5*a*), through the retention clip 100, through the bent disk spring 102, through the metal surge arrestor cap 112, through the body of the surge arrestor 110 to a metal bulkhead 104 and finally to ground. FIG. 4 shows how the surge arrestor 110 is connected to the grounded metal bulkhead 104.

The drawback of the prior surge arrestor clip design is that it consisted of two individual parts, a retention clip 100 and a bent disk spring 102. This two-piece design increased the difficulty of installing a new gas tube element and increased orientation errors during assembly. In addition, the two pieces would often get caught together during shipping and handling, making them difficult to separate. Moreover, the prior two-piece design was difficult and expensive to manufacture. For example, it takes approximately 400 hours to manufacture 25,000 bent disk springs and 25,000 retention clips. The cost to manufacture 25,000 bent disk springs is approximately $2.00 each and the cost to manufacture 25,000 retention clips is approximately $3.30 each; thus, the two-piece design costs approximately $5.30 each to produce.

Therefore, there is a need for a simpler surge arrestor clip design that reduces the number of parts required, greatly reduces production costs, and reduces the complexity of assembling the surge arrestor and installing and replacing gas tube elements.

SUMMARY OF THE INVENTION

A one-piece spring clip is provided for retaining a gas tube element used in a surge arrestor having a cap with an interior portion. The spring clip includes a generally flat disk having a periphery, a first side and a second side. A plurality of first tabs extend from the first side of the disk at the periphery thereof to retain the gas tube element. A plurality of second tabs extend from the second side of the disk at the periphery thereof to provide a spring force between the interior portion of the cap and the gas tube element.

BRIEF DESCRIPTION OF THE DRAWINGS

Other objects and advantages of the invention will become apparent upon reading the following detailed description and upon reference to the accompanying drawings, in which:

FIG. 4 is an exploded perspective view of the surge arrestor assembly of FIG. 1 and a metal bulkhead;

FIG. 5 is a side, partial cross-sectional view of the surge arrestor assembly and bulkhead of FIG. 4 showing how the surge arrestor assembly operates in response to a transient;

FIG. 5*a* is an enlarged view of the inside of a gas tube element in the surge arrestor assembly of FIG. 5;

FIG. 6 is an exploded side, partial cross-sectional view of a surge arrestor assembly including a spring clip according to one embodiment of the present invention;

Figure 1:
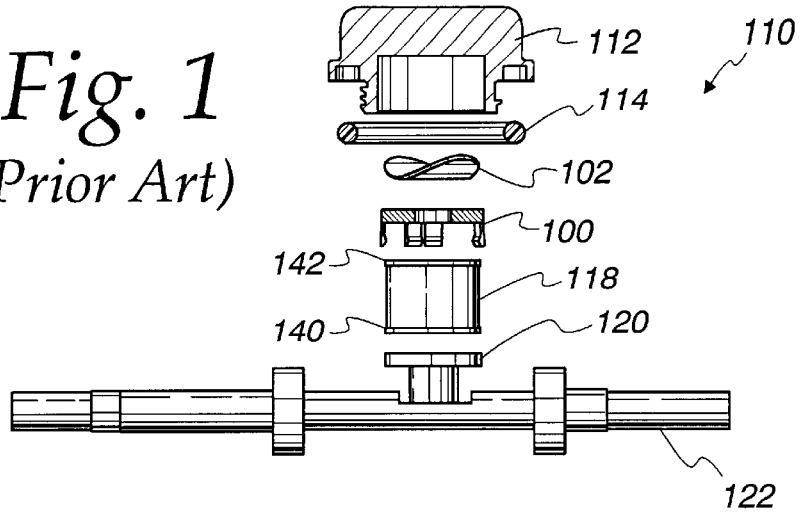
Fig. 1 (Prior Art)
FIG. 1 is an exploded side, partial cross-sectional view of a surge arrestor assembly including a prior art retention clip.
Figure 2A:
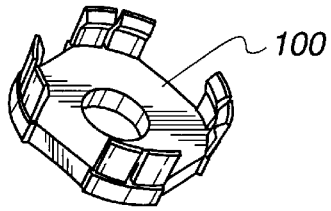
Fig. 2a (Prior Art)
FIG. 2*a* is a perspective view of the prior art retention clip of FIG. 1.
Figure 2B:
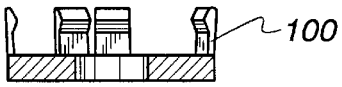
Fig. 2b (Prior Art)
FIG. 2*b* is a cross-sectional view of the prior art retention clip of FIG. 2*a;*
Figure 3:
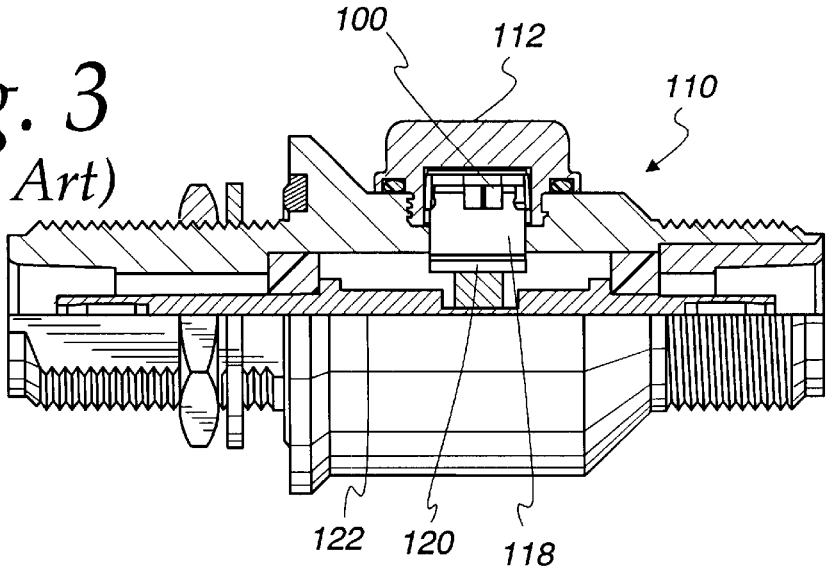
Fig. 3 (Prior Art)
FIG. 3 is a side, partial cross-sectional view of the surge arrestor assembly of FIG. 1 in an assembled condition.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 7:
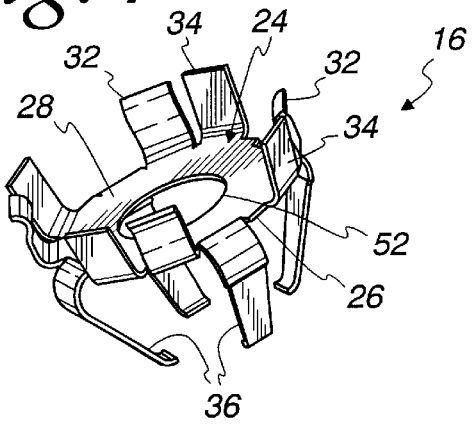
FIG. 7 is a perspective view of the spring clip of FIG. 6.
Figure 8:
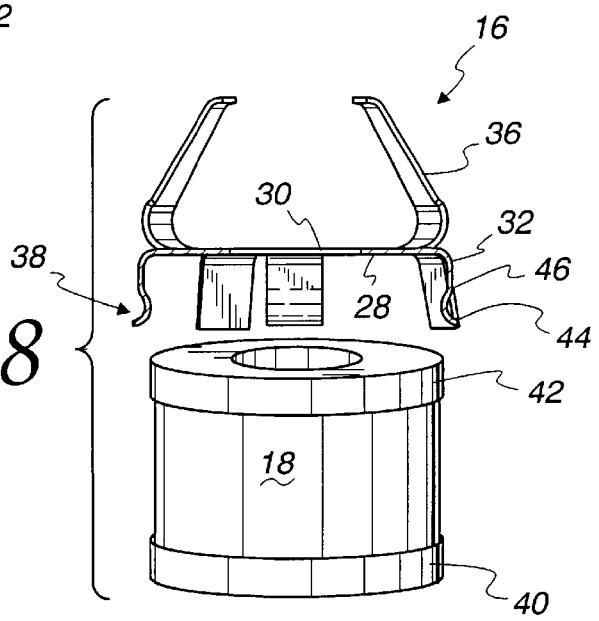
FIG. 8 is a side, partial cross-sectional view of the spring clip of FIG. 6 and a gas tube element.

Referring initially to FIG. 6, a surge arrestor 10 is shown. The surge arrestor 10 includes a surge arrestor cap 12, an annular seal 14, a one-piece spring clip 16, a gas tube element 18, a center disk 20, and a center conductor 22. The spring clip 16 fits into the surge arrestor cap 12 and retains the gas tube element 18. As shown in FIGS. 7 and 8, the one-piece spring clip 16 includes a generally flat disk 24 having a periphery 26, a first side 28 and a second side 30. The first side 28 of the flat disk 24 has a plurality of first tabs 32 and second tabs 34 extending therefrom. The second side 30 of the flat disk 24 has a plurality of third tabs 36 extending therefrom. The gas tube element 18 includes a first electrode 40 and a second electrode 42, as shown in FIG. 8.

In one embodiment, the first tabs 32 each include a distal end having an outwardly curved portion 38, as shown in FIG. 8. The outwardly curved portion 38 snaps over the second electrode 42 of the gas tube element 18. The outwardly curved portion 38 includes, at the distal end of each of the first tabs 32, a first arcuate portion 44 which helps to minimize damage to the distal end of the first tabs 32 when the gas tube element 18 is inserted into the spring clip 16. The outwardly curved portion further includes a second arcuate portion 46 which accommodates diameter tolerances in various gas tube elements. The first tabs 32 can flex outwardly at an angle greater than 90 degrees relative to the first side 28 to accommodate gas tube elements with a positive tolerance value (e.g., gas tube elements are typically 8 mm in diameter +/−0.005–0.008 mm). The second arcuate portion 46 provides a portion of the outwardly curved portion 38 which applies inward pressure against the gas tube element 18 for retaining the gas tube element 18 in the spring clip 16. Thus, the first tabs 32 retain the gas tube element 18 such that it will not fall out of the surge arrestor cap 12 when the gas tube element 18 is being replaced. However, when a sufficient amount of extraction force is applied to the gas tube element 18, the first tabs 32 will release the gas tube element 18. In one embodiment, the first tabs 32 are spaced equally around the periphery 26 of the disk 24, as shown in FIG. 7.

Figure 9A:
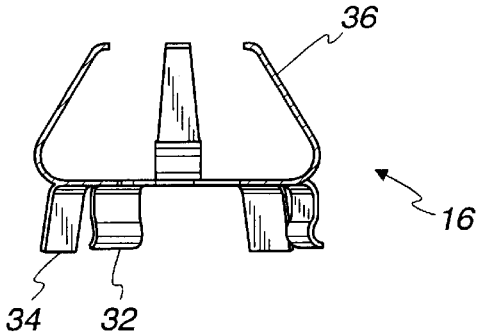
FIG. 9*a* is a side, partial cross-sectional view of the spring clip of FIG. 6 before being inserted into a surge arrestor cap.
Figure 9B:
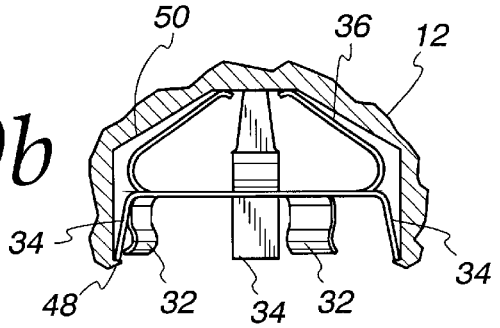
FIG. 9*b* is a side, partial cross-sectional view of the spring clip of FIG. 6 after being inserted into a surge arrestor cap.

In another embodiment, the second tabs 34 are tapered outward and oriented at an angle greater than 90 degrees relative to the first side 28 to retain the spring clip 16 in the cap 12, as shown in FIG. 9*b*. The second tabs 34 snap over a protruding annular surface 48 to secure the spring clip 16 in the cap 12. In one embodiment, the second tabs 34 are spaced equally around the periphery 26 of the disk 24, as shown in FIG. 7.

In still another embodiment, the surge arrestor cap 12 has a concave inner surface 50, as shown in FIG. 6. The third tabs 36 are tapered inward and oriented at approximately 45 degrees relative to the second side 30 to provide a spring force between the concave inner surface 50 of the cap 12 and the gas tube element 18, as shown in FIGS. 9*a* and 9*b*. In one embodiment, the third tabs 36 are spaced equally around the periphery 26 of the disk 24, as shown in FIG. 7.

The gas tube element 18 is replaceable. Thus, after a transient has been shunted to ground, the gas tube element 18 can be replaced to ensure maximum surge protection against future transients. Likewise, the gas tube element 18 can be replaced as part of a routine maintenance program to ensure that the gas tube element 18 is functioning at the expected level of performance and not at a degraded level. For instance, the gas tube element 18 could be degraded by small voltage surges that are not enough to drastically alter or destroy the gas tube element 18.

Gas tube elements are rated by the voltage level at which a spark is generated between the electrodes, this voltage is referred to as the"spark over" voltage. If a gas tube element is rated for 230 volts, then any time the voltage in the transmission line exceeds 230 volts, an arc is formed between the electrodes in the gas tube element. This arc provides a low impedance path to ground protecting whatever equipment is attached to the transmission line. If small voltage surges occur on the transmission line, they will most likely not cause much degradation of the gas tube element. If moderate voltage surges occur, they will mostly likely cause the electrodes to burn away to some degree thus increasing the spark over voltage to, e.g., 500 volts. Therefore, the 230 volt gas tube element will not shunt transients to ground when it is supposed to allowing dangerous current and/or voltage levels to reach the equipment attached to the transmission line, very possibly damaging it. If a high voltage surge occurs, it will most likely burn away the electrodes in the gas tube element partially or completely, thus greatly reducing or eliminating the surge protection. Thus, gas tube elements must be replaced periodically or after a moderate or high transient. To replace a gas tube element in a surge arrestor using the present invention, the surge arrestor cap 12 is unscrewed and the gas tube element 18 is removed and replaced with a new one.

The gas tube element 18 is offered in a plurality of spark over voltages. To select the proper gas tube element, one skilled in the art would merely calculate the maximum voltage tolerable on the particular transmission line. In one embodiment, the gas tube element 18 can divert transient surge currents reaching a peak of 20 kA to ground without causing any appreciable degradation to the gas tube element 18.

Generally, a simple tool is used to install the spring clip 16 into the cap 12. The tool is used to push on the disk 24 until the second tabs 34 snap over the protruding annular surface 48, as shown in FIG. 9*b*. Once snapped in, the third tabs 36 are biased against the concave inner surface 50 of the cap 12.

Figure 10A:
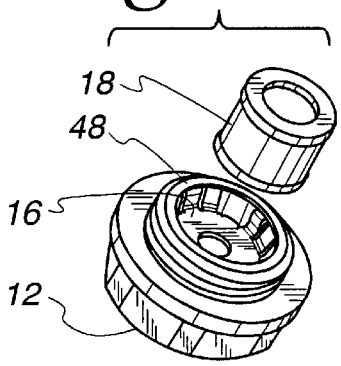
FIG. 10*a* is an exploded perspective view of the spring clip of FIG. 6, a surge arrestor cap and a gas tube element.
Figure 10B:
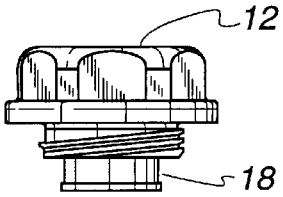
FIG. 10*b* is a side view of the surge arrestor cap and the gas tube element of FIG. 10*a;*
Figure 10C:
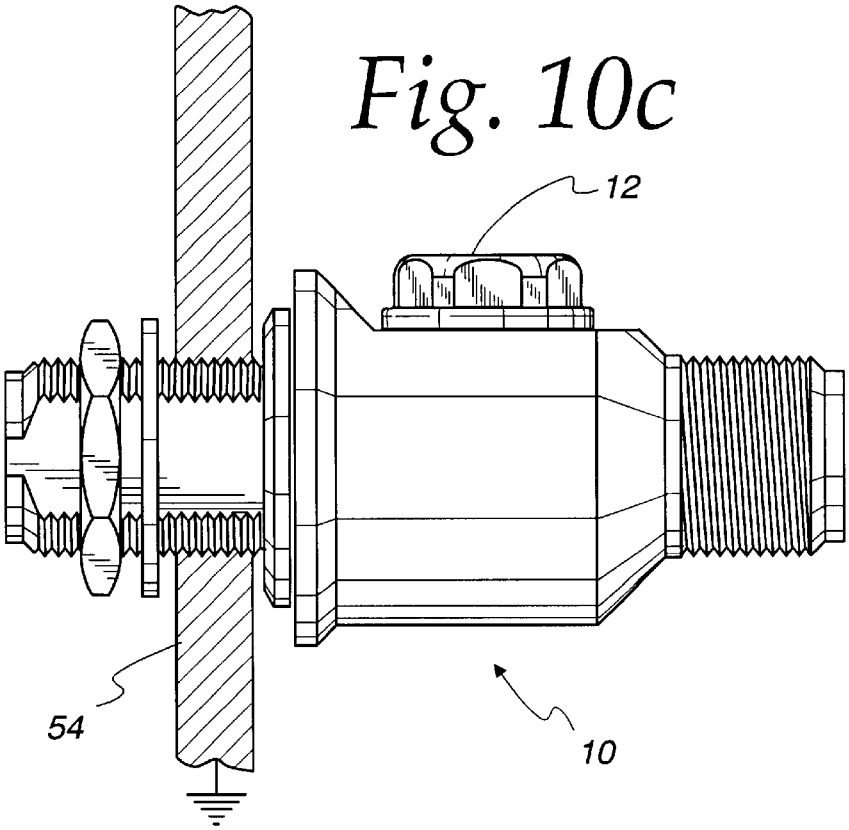
FIG. 10*c* is a partial cross-sectional side view of the surge arrestor assembly of FIG. 6 in a metal bulkhead.

FIGS. 10*a*–10*c* show how to replace the gas tube element 18. First, the surge arrestor cap 12 is removed from the surge arrestor 10, as shown in FIG. 10*b*. Then, the gas tube element 18 is removed from the surge arrestor cap 12, as shown in FIG. 10*a*. The spring clip 16 remains in the surge arrestor cap 12 due to the second tabs 34 being restrained by the protruding annular surface 48. A new gas tube element 18 is then inserted into the spring clip 16 by pushing the gas tube element 18 into the first tabs 32 such that the first tabs 32 clip over the second electrode 42. The first tabs 32 secure the new gas tube element 18 in the spring clip 16 and thus in the surge arrestor cap 12. The surge arrestor cap 12 is then screwed into a surge arrestor 10 to form a functional unit, as illustrated in FIG. 10*c*. The system connected to the transmission line can then be turned back on. With a functional surge arrestor 10, the system is protected from transients greater than the spark over voltage of the gas tube element 18.

The one-piece spring clip 16 of the present invention has several advantages over prior two-piece designs. The spring clip 16 allows the gas tube element 18 to be easily installed and replaced without bending or breaking the spring clip 16, as shown in FIG. 6. The spring clip 16 provides spring pressure on the gas tube element 18 to ensure good mechanical contact and good contact resistance between the first electrode 40 and the center disk 20 which is connected to the center conductor 22 of a transmission line. Good contact resistance is defined as a low electrical resistance connection between two parts. The spring clip 16 also provides spring pressure on the gas tube element 18 to ensure good mechanical contact and good contact resistance between the second electrode 42 and the metal surge arrestor cap 12. Good contact resistance between the second electrode 42 and the metal surge arrestor cap 12 ensures that transient surges are conducted through the center conductor 22, through the center disk 20, through the gas tube element 18, through the spring clip 16, through the surge arrestor cap 12, through the body of the surge arrestor 10 to a metal bulkhead 54 and finally to ground, as shown in FIGS. 6 and 10*c*. Thus, gas tube surge arrestors pass a broad range of frequencies (e.g., between 0–2.3 GHz) while shorting transient surges to ground.

Figure 11:
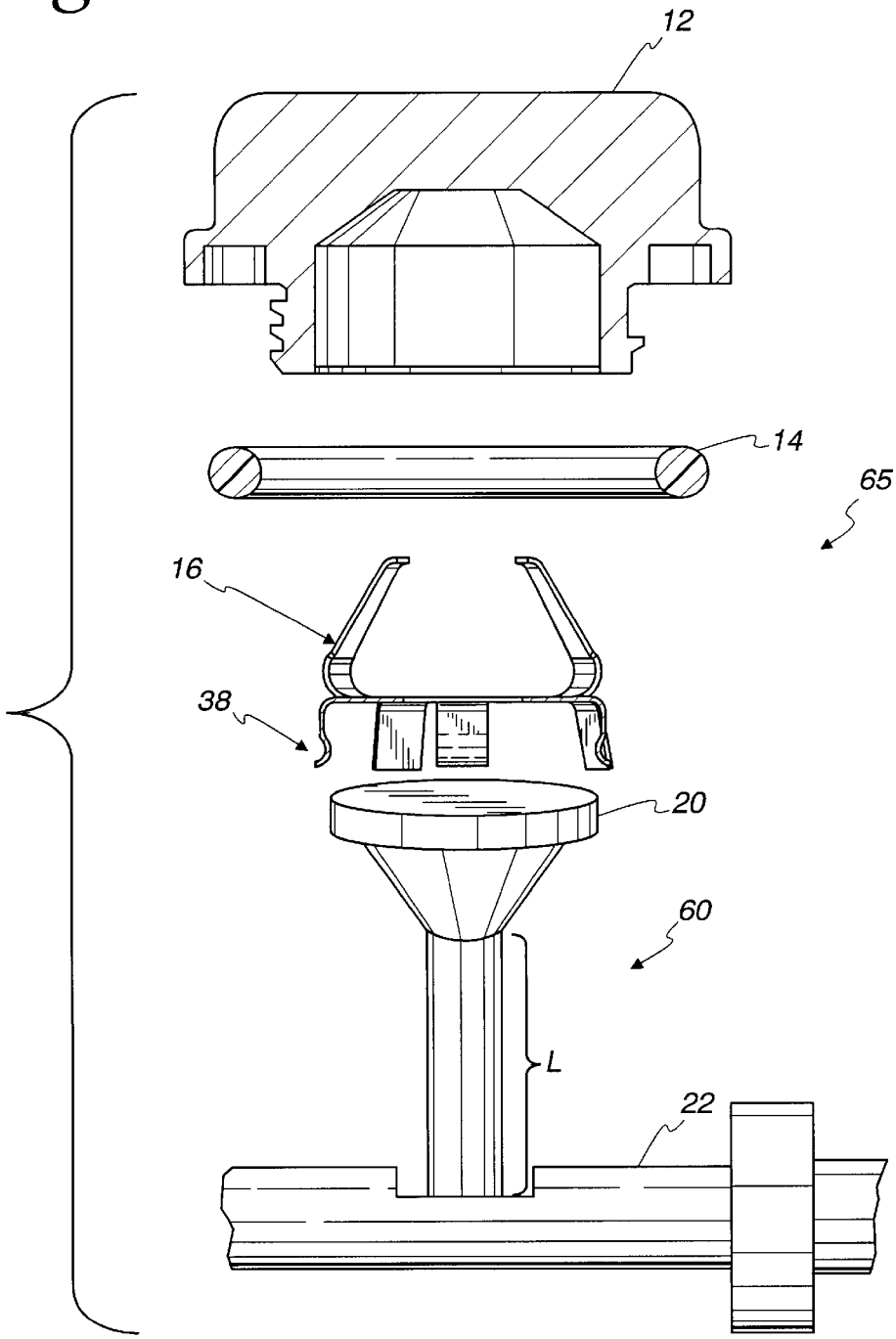
FIG. 11 is an exploded side, partial cross-sectional view of a spring clip according to another embodiment of the present invention.

In another embodiment, a shorting stub surge arrestor 65 is provided which includes a surge arrestor cap 12, an annular seal 14, a one-piece spring clip 16, a quarter wavelength shorting stub 60, a center disk 20, and a center conductor 22, as shown in FIG. 11. (Elements having the same reference numbers are the same as previously described.) Similar to the gas tube element surge arrestor 10 described above, the spring clip 16 fits into the surge arrestor cap 12 by snapping over the protruding annular surface 48. The first tabs 32 of the spring clip 16 mate with the center disk 20. The center disk 20 is connected to the quarter wavelength shorting stub 60 which allows a narrow band of frequencies to be transmitted on the transmission line. Other frequencies (such as those associated with transients) are filtered out and not transmitted. Shorting stub surge arrestors are known in the art and thus will not be elaborated on here. Suffice it to say that depending on the length L of the shorting stub 60, different frequencies can be transmitted on the transmission line. The characteristics of a shorting stub surge arrestor, also known as a "Quarter Wave Stub" (QWS) are not unlike a bandpass filter in that RF signals at the center of the frequency band pass unattenuated, while out-of band signals, including lightning transients, are diverted harmlessly to ground. While the higher frequency bandpass characteristics are periodical, the frequency components of lightning transients are near DC with components of decreasing energy values extending through 160 KHz.

In this embodiment, the spring clip 16 provides spring pressure between the inner surface 50 of the cap 12 and the center disk 20. This pressure ensures good mechanical contact and good contact resistance between the center disk 20 and the metal surge arrestor cap 12. Good contact resistance between the center disk 20 and the metal surge arrestor cap 12 ensures that the desired frequencies are transmitted through the center conductor 22 and frequencies outside the passband (such as transient frequencies) are filtered out. (The substantial energy associated with, e.g., lightning transients has frequency components near DC or 0 Hz with components of decreasing magnitude extending through 160 KHz).

The composition of the spring clip 16 allows it to withstand transient surges, such as those induced by lightning, without deforming or degrading the spring clip 16. In one embodiment, the spring clip 16 is made from beryllium copper ASTM C17200 or ASTM C17410. "ASTM" stands for the American Society for Testing and Materials which develops and provides voluntary consensus standards and related technical information and services. The "C" stands for copper and the 17200 and 17410 are different copper alloys. In one embodiment, the spring clip 16 (including its tabs and disk) is about 0.006" to 0.008" thick.

The one-piece spring clip 16 also possesses several manufacturing and assembly advantages over prior two-piece designs. Specifically, the one-piece spring clip 16 minimizes the number of parts required to be installed into the surge arrestor cap 12, makes it less likely that parts will get caught together during handling, and minimizes orientation problems between parts. The one-piece design of the spring clip 16 makes it easier to handle, ship, store and install than prior two-piece designs. The new one-piece design is also easier and less expensive to manufacture than prior two-piece designs. The one-piece design can be manufactured very quickly using a high speed stamping process. For example, 25,000 pieces can be manufactured in about 12 hours or less at a cost of $0. 10 each. As shown in FIG. 7, the flat disk 24 includes an annular opening 52 in the center thereof to help register the spring clip 16 during the manufacturing process.

The present invention provides a spring clip 16 that is configured to retain a cylindrical gas tube element 18 in a surge arrestor cap 12 of a surge arrestor 10. The one-piece spring clip 16 self-fastens and self-aligns to the concave inner surface 50 of the surge arrestor cap 12. The spring clip 16 also concentrically aligns the gas tube element 18 with the cylindrical interior of the surge arrestor cap 12, as shown in FIG. 10*a*. This provides consistent high frequency performance by ensuring: (1) that the entire surface of the second electrode 42 is in contact with the center conductor disk 24, which is connected to the center conductor 22 of the transmission line being grounded, as shown in FIG. 6, or (2) spring pressure between the inner surface 50 of the cap 12 and the center disk 20 such that the desired frequencies are transmitted through the center conductor 22 and frequencies outside the passband (such as transient frequencies) are filtered out by the shorting stub 60.

The present invention combines the functions of the prior two-piece retention clip/bent disk spring design into a one-piece spring clip 16. The structural geometry of the one-piece spring clip 16 allows it to be manufactured using a high speed stamping operation which results in a highly repeatable manufacturing process which greatly decreases the production time and the cost per unit relative to producing the prior two-piece design. The spring clip 16 also reduces the time and effort required to install the spring clip 16 in the surge arrestor cap 12 and to install and replace gas tube elements 18. Thus, the present invention offers several advantages that are currently not offered in any single product.

While the present invention has been described with reference to one or more embodiments, those skilled in the art will recognize that many changes may be made thereto without departing from the spirit and scope of the present invention which is set forth in the following claims.

What is claimed is:

1. A one-piece spring clip for retaining a gas tube element used in a surge arrestor, the surge arrestor having a cap with an interior portion, the spring clip comprising:

a generally flat disk having a periphery, a first side and a second side;

a plurality of tabs extending from the first side of the disk at the periphery thereof to retain the gas tube element; and a plurality of tabs extending from the second side of the disk at the periphery thereof to provide a spring force between the interior portion of the cap and the gas tube element.

2. The one-piece spring clip of claim 1, wherein the plurality of tabs extending from the first side of the disk include at least four tabs.

3. The one-piece spring clip of claim 1, wherein the plurality of tabs extending from the second side of the disk include at least four tabs.

4. The one-piece spring clip of claim 1, wherein the plurality of first tabs extending from the first side of the disk include at least six tabs.

5. The one-piece spring clip of claim 1, wherein the plurality of tabs extending from the first side of the disk each include a distal end having an outwardly curved portion.

6. The one-piece spring clip of claim 1, wherein the spring clip is made of metal.

7. The one-piece spring clip of claim 1, wherein the spring clip is made from beryllium copper.

8. The one-piece spring clip of claim 1, wherein the tabs extending from the first side of the disk are spaced equally around the periphery of the disk.

9. The one-piece spring clip of claim 1, wherein the tabs extending from the second side of the disk are spaced equally around the periphery of the disk.

10. The one-piece spring clip of claim 1, wherein the cap includes a protruding annular surface, further including a plurality of tabs that are tapered outward and oriented at an angle greater than 90 degrees relative to the first side to retain the spring clip in the cap by snapping over the protruding annular surface.

11. The one-piece spring clip of claim 1, wherein the tabs extending from the second side of the disk are tapered inward and oriented at approximately 45 degrees relative to the second side.

12. The one-piece spring clip of claim 1, wherein the flat disk includes an annular opening in the center thereof.

13. A one-piece spring clip for retaining a gas tube element used in a surge arrestor, the spring clip comprising:

a generally flat disk having a periphery, a first side and a second side;

a plurality of first tabs extending from the first side of the disk at the periphery thereof, the first tabs each including a distal end having an outwardly curved portion;

a plurality of second tabs extending from the first side of the disk at the periphery thereof; and a plurality of third tabs extending from the second side of the disk at the periphery thereof.

14. The one-piece spring clip of claim 13, wherein the first tabs are spaced equally around the periphery of the disk.

15. The one-piece spring clip of claim 13, wherein the second tabs are spaced equally around the periphery of the disk.

16. The one-piece spring clip of claim 13, wherein the surge arrestor includes a cap having a protruding annular surface, the second tabs being tapered outward and oriented at an angle greater than 90 degrees relative to the first side to retain the spring clip in the cap by snapping over the protruding annular surface.

17. The one-piece spring clip of claim 13, wherein the third tabs are tapered inward and oriented at approximately 45 degrees relative to the second side.

18. The one-piece spring clip of claim 13, wherein the first tabs retain the gas tube element.

19. A one-piece spring clip for retaining a gas tube element used in a surge arrestor, the spring clip comprising:

a generally flat disk having a periphery, a first side and a second side;

a plurality of first tabs extending from the first side of the disk at the periphery thereof, the first tabs each including a distal end having an outwardly curved portion;

a plurality of second tabs extending from the first side of the disk at the periphery thereof, the second tabs being tapered outward and oriented at an angle greater than 90 degrees relative to the first side; and a plurality of third tabs extending from the second side of the disk at the periphery thereof, the third tabs being tapered inward and oriented at approximately 45 degrees relative to the second side.

20. The one-piece spring clip of claim 19, wherein the outwardly curved portion includes a first arcuate portion at the distal end of each tab and a second arcuate portion.

21. The one-piece spring clip of claim 19, wherein the first tabs are spaced equally around the periphery of the disk.

22. The one-piece spring clip of claim 19, wherein the second tabs are spaced equally around the periphery of the disk.

23. The one-piece spring clip of claim 19, wherein the cap includes a protruding annular surface, the second tabs retaining the spring clip in the cap by snapping over the protruding annular surface.

24. The one-piece spring clip of claim 19, wherein the surge arrestor includes a cap with an interior portion, the third tabs providing a spring force between the interior portion of the cap and the gas tube element such that a low electrical resistance connection is formed between the gas tube element and the interior portion of the cap.

25. A one-piece spring clip for retaining a gas tube element used in a surge arrestor, the surge arrestor including a cap with an interior portion and a protruding annular surface, the spring clip comprising:

a generally flat disk having a periphery, a first side and a second side;

a plurality of first tabs extending from the first side of the disk at the periphery thereof to retain a gas tube element, the first tabs including a first arcuate portion at the distal end of each tab to minimize damage to the distal end thereof when the gas tube element is inserted into the spring clip, the first tabs further including a second arcuate portion that provides a spring force for retaining the gas tube element;

a plurality of second tabs extending from the first side of the disk at the periphery thereof, the second tabs being tapered outward and oriented at an angle greater than 90 degrees relative to the first side to retain the spring clip in the cap by snapping over the protruding annular surface; and a plurality of third tabs extending from the second side of the disk at the periphery thereof, the third tabs being tapered inward and oriented at approximately 45 degrees relative to the second side to provide a spring force between the interior portion of the cap and the gas tube element such that a low electrical resistance connection is formed between the gas tube element and the interior portion of the cap.

26. The one-piece spring clip of claim 25, wherein the first tabs are spaced equally around the periphery of the disk.

27. The one-piece spring clip of claim 25, wherein the second tabs are spaced equally around the periphery of the disk.

28. The one-piece spring clip of claim 25, wherein the third tabs are spaced equally around the periphery of the disk.

29. A one-piece spring clip for use in a surge arrestor, the spring clip being configured to mate with a shorting stub having a center disk, the spring clip comprising:

a generally flat disk having a periphery, a first side and a second side;

a plurality of tabs extending from the first side of the disk at the periphery thereof to mate with the center disk; and a plurality of tabs extending from the second side of the disk at the periphery thereof.

30. The one-piece spring clip of claim 29, wherein the plurality of tabs extending from the first side of the disk each include a distal end having an outwardly curved portion.

31. The one-piece spring clip of claim 29, wherein the tabs extending from the first side of the disk are spaced equally around the periphery of the disk.

32. The one-piece spring clip of claim 29, wherein the tabs extending from the second side of the disk are spaced equally around the periphery of the disk.

33. The one-piece spring clip of claim 29, wherein the surge arrestor includes a cap having a protruding annular surface, further including a plurality of tabs that are tapered outward and oriented at an angle greater than 90 degrees relative to the first side to retain the spring clip in the cap by snapping over the protruding annular surface.

34. The one-piece spring clip of claim 29, wherein the tabs extending from the second side of the disk are tapered inward and oriented at approximately 45 degrees relative to the second side.

35. A method of using a one-piece spring clip for retaining a gas tube element in a surge arrestor cap having an interior portion, the method comprising:

providing a spring clip including a generally flat disk having a periphery, a first side and a second side, the flat disk having a plurality of tabs extending from the first side of the disk at the periphery thereof and a plurality of tabs extending from the second side of the disk at the periphery thereof;

inserting the gas tube element into the spring clip; and biasing the spring clip between the interior portion of the cap and the gas tube element.

36. The method of claim 35, wherein the gas tube element includes an end electrode, wherein inserting the gas tube element into the spring clip includes pushing the gas tube element into the tabs extending from the first side of the disk such that those tabs clip over the end electrode.

37. The method of claim 35, further including screwing the surge arrestor cap into a surge arrestor.

38. A surge arrestor comprising:

a surge arrestor cap having an interior portion;

a gas tube element; and a one-piece spring clip including a generally flat disk having a periphery, a first side and a second side, the flat disk having a plurality of tabs extending from the first side of the disk at the periphery thereof to retain the gas tube element and a plurality of tabs extending from the second side of the disk at the periphery thereof to provide a spring force between the interior portion of the cap and the gas tube element.

39. The surge arrestor of claim 38, wherein the plurality of tabs extending from the first side of the disk each include a distal end having an outwardly curved portion.

40. The surge arrestor of claim 38, wherein the tabs extending from the first side of the disk are spaced equally around the periphery of the disk.

41. The surge arrestor of claim 38, wherein the tabs extending from the second side of the disk are spaced equally around the periphery of the disk.

42. The surge arrestor of claim 38, wherein the cap includes a protruding annular surface, further including a plurality of tabs that are tapered outward and oriented at an angle greater than 90 degrees relative to the first side to retain the spring clip in the cap by snapping over the protruding annular surface.

43. The surge arrestor of claim 38, wherein the tabs extending from the second side of the disk are tapered inward and oriented at approximately 45 degrees relative to the second side.

* * * * *